US006705027B1

(12) United States Patent
Campbell

(10) Patent No.: US 6,705,027 B1
(45) Date of Patent: Mar. 16, 2004

(54) TRACTION ELEMENTS FOR AN ARTICLE OF FOOTWEAR

(75) Inventor: Derek Campbell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 2 days.

(21) Appl. No.: 10/161,099

(22) Filed: May 30, 2002

Related U.S. Application Data

(63) Continuation-in-part of application No. 10/093,362, filed on Mar. 5, 2002.

(51) Int. Cl.[7] ..... A43C 15/02
(52) U.S. Cl. ..... 36/127; 36/59 R; 36/59 C
(58) Field of Search ..... 36/127, 59 R, 36/59 C, 67 R, 67 A, 126, 128

(56) References Cited

U.S. PATENT DOCUMENTS

| | | | | |
|---|---|---|---|---|
| 911,479 A | | 2/1909 | Doughty | |
| 1,087,212 A | | 2/1914 | Caldwell | |
| 3,555,697 A | | 1/1971 | Dassler | |
| 4,045,888 A | * | 9/1977 | Oxenberg | 36/114 |
| 4,096,649 A | * | 6/1978 | Saurwein | 36/32 R |
| 4,233,759 A | * | 11/1980 | Bente et al. | 36/59 R |
| 4,266,349 A | | 5/1981 | Schmohl | |
| 4,327,503 A | | 5/1982 | Johnson | |
| 4,347,674 A | | 9/1982 | George | |
| 4,375,728 A | * | 3/1983 | Dassler | 36/32 R |
| 4,402,145 A | | 9/1983 | Dassler | |
| 4,445,286 A | | 5/1984 | Norton | |
| 4,470,207 A | * | 9/1984 | Bente | 36/134 |
| 4,586,274 A | | 5/1986 | Blair | |
| 4,667,425 A | | 5/1987 | Effler et al. | |
| 4,670,997 A | | 6/1987 | Beekman | |
| 4,689,901 A | | 9/1987 | Ihlenburg | |
| D294,655 S | | 3/1988 | Heyes | |
| D295,231 S | | 4/1988 | Heyes | |
| 4,745,693 A | | 5/1988 | Brown | |
| 4,885,851 A | | 12/1989 | Peterson | |
| 4,914,838 A | | 4/1990 | Ihlenburg | |
| D323,738 S | | 2/1992 | Eisenbach | |
| D324,763 S | | 3/1992 | Kayano | |
| 5,203,097 A | | 4/1993 | Blair | |
| 5,313,718 A | | 5/1994 | McMahon et al. | |
| D354,845 S | | 1/1995 | Bramani | |
| D371,893 S | | 7/1996 | Kayano et al. | |
| D373,898 S | | 9/1996 | Bramani | |
| 5,628,129 A | | 5/1997 | Kilgore et al. | |
| D391,044 S | | 2/1998 | Backus | |
| D392,448 S | | 3/1998 | Backus | |
| 5,752,332 A | * | 5/1998 | Kataoka et al. | 36/134 |

(List continued on next page.)

OTHER PUBLICATIONS

Keith R. Williams et al., "The Mechanics of Foot Action During the Golf Swing and Implications for Shoe Design," Medicine and Science in Sports and Exercise, vol. 15, No. 3, pp247–255.

1999 NIKE Golf Footwear/Equipment Catalog, published Jun. 1998, cover page and one page.

2000 NIKE Golf Footwear Catalog, published Jun. 1999, cover page and two pages.

*Primary Examiner*—Ted Kavanaugh
(74) *Attorney, Agent, or Firm*—Banner & Witcoff, Ltd.

(57) ABSTRACT

The invention is a traction element for an article of footwear that reduces rotation in the footwear during activities such as golf. The traction elements are configured to penetrate the ground and include undercut surfaces that contact the ground. During a golf swing, for example, the ground will induce a force upon the undercut surfaces, thereby deforming the traction element and securely engaging the traction element with the ground. The traction elements may also have back surfaces opposite the undercut surface that assist with disengaging the traction elements following the golf swing.

47 Claims, 6 Drawing Sheets

U.S. PATENT DOCUMENTS 5,768,809 A 6/1998 Savoie
5,832,636 A 11/1998 Lyden et al.
5,873,184 A 2/1999 Ihlenburg
5,987,782 A 11/1999 Bramani
6,016,613 A 1/2000 Campbell et al.
6,018,893 A * 2/2000 Workman ..... 36/134
6,161,315 A 12/2000 Dalton
D443,407 S 6/2001 Patterson et al.
6,295,742 B1 * 10/2001 Bathum ..... 36/59 R

* cited by examiner

TRACTION ELEMENTS FOR AN ARTICLE OF FOOTWEAR

This application is a continuation-in-part of U.S. patent application Ser. No. 10/093,362, filed Mar. 5, 2002, which is hereby incorporated by reference.

BACKGROUND OF THE INVENTION

1. Field of the Invention

The present invention relates to footwear. The invention concerns, more particularly, elements that protrude from a footwear sole to provide dynamic traction.

2. Description of Background Art

The game of golf is one of the oldest international sports and has its formal origins in the $16^{th}$ century at The Royal and Ancient Golf Club at St. Andrews, located in Scotland. During the ensuing centuries, the game of golf has gained and maintained a populous following due to inherent challenges of the game, a prestigious reputation, and its suitability for relaxation.

Growth in the number of individuals playing the game of golf provides an incentive for manufacturers of golf equipment, which includes golf clubs, golf balls, and golf shoes, to improve upon the various features and characteristics of golf equipment. In general, golf equipment has evolved over time to provide enhanced performance and suitability for a wide range of playing abilities and styles. Golf club shafts, for example, were originally fashioned from wood and are commonly formed of metal or graphite materials today. Golf balls originally included a wound, twine core and a balata rubber cover. Modern golf balls, however, may incorporate a solid core formed of polybutadiene, titanium, nickel, or cobalt, and a cover formed of ionomeric resin, surlyn, or polyurethane. Similarly, advances in golf shoe outsoles are of particular interest to sporting goods manufacturers, especially with respect to enhancing performance by insuring controlled contact with the ground while permitting the body to correctly pivot for purposes of swinging a golf club.

A proper golf club swing involves a side-to-side twisting motion that coordinates movement of the arms, torso, hips, legs, and feet of the golfer. Initially, the weight of the golfer is uniformly distributed over each foot. As the golfer begins the back swing, the driving foot, which is positioned furthest from the flag, tends to experience an increased vertical force and tends to rotate laterally outward in the forefoot region and medially inward in the heel region. During the back swing, the driving foot acts as a brace and counters rotation of the torso, hips, and legs. Accordingly, a majority of the weight of the golfer shifts to the driving foot during the back swing such that the stabilizing foot, which is positioned closest to the flag, supports only a small portion of the weight of the golfer. During the down swing, the golfer's weight is shifted from the driving foot to the stabilizing foot, which has a tendency to rotate in a manner that is similar to the driving foot during the back swing. That is, the stabilizing foot tends to rotate laterally outward in the forefoot region and medially inward in the heel region.

Traditional golf shoes include a generally smooth outsole having a plurality of fixed or removable spikes that engage the ground and prevent each foot from slipping during the golf club swing. Although metal spikes are effective for preventing the feet from slipping, the spikes may damage putting greens, walkways, floors, and other surfaces that the golfer walks upon. Metal spikes may also pose a hazard to the golfer or other individuals. Many modern golf shoes, however, continue to incorporate metal spikes.

A modified golf shoe is disclosed in U.S. Pat. No. 4,885,851 to Peterson and includes an outsole with a flat, ground engaging surface and spikes positioned in the forefoot and heel regions. In addition, the outsole includes a plurality of supplementary protrusions distributed along a medial side of the right shoe and along the lateral side of the left shoe to aid a right-handed golfer. An opposite configuration is disclosed for a left-handed golfer. One purpose of the supplementary protrusions is to inhibit the shoes from slipping as the golfer shifts weight from the driving foot to the stabilizing foot during the golf swing.

Golf shoes may also be structured in a manner that considers the rotational motion of the feet during the various stages of the golf swing, as discussed above, in addition to the tendency for slipping throughout the golf swing. U.S. Pat. No. 6,016,613 to Campbell et al. discloses a golf shoe outsole with a plurality of polymer projections. The various projections are configured to extend outward in a radial geometry from a pivot point in the forefoot region and another pivot point in the heel region, thereby controlling the rotational motion of the feet during the various portions of the golf swing. In addition, the outsole may incorporate traditional metal spikes or modern polymer spikes.

BRIEF SUMMARY OF THE INVENTION

The present invention is an article of footwear having an upper for receiving a foot and a sole structure attached to the upper. The sole structure includes an outsole with an exposed surface and a plurality of traction elements projecting from the exposed surface. The traction elements have an end portion located opposite the exposed surface and an undercut surface that extends between the exposed surface and the end portion to form an acute angle with the exposed surface. A forefoot portion of the traction elements are located in a forefoot area of the sole structure, and a heel portion of the traction elements are located in a heel area of the sole structure. The undercut surfaces of the forefoot portion are oriented to generally face a lateral side of the footwear, and the undercut surfaces of the heel portion are oriented to generally face a medial side of the footwear.

The undercut surfaces of the traction elements engage the ground and resist rotation of the footwear. When an individual stands on a compliant surface, such as turf, the traction elements will protrude into the ground such that the undercut surfaces contact the ground. As the foot rotates, the ground presses against the undercut surfaces and deforms the traction elements, thereby increasing the angle that the undercut surfaces form with the ground. The angle, however, generally remains acute such that the traction elements continue to remain securely engaged with the ground.

During the back swing portion of a golf swing, the driving foot tends to rotate laterally outward in the forefoot area and medially inward in the heel area. Similarly, the stabilizing foot tends to rotate laterally outward in the forefoot area and medially inward in the heel area during the down swing. By orienting the traction elements such that the undercut surfaces face the lateral side in the forefoot area and the medial side in the heel area, rotation of the feet during the various portions of the golf swing may be effectively controlled.

The traction elements may also be utilized to provide the individual with additional cushioning. As the individual walks, the traction elements deform such that the angle between the undercut surface and the exposed surface decreases. The deformation in the traction elements effectively attenuates impact forces and absorbs energy, thereby providing the individual with cushioning.

The advantages and features of novelty that characterize the present invention are pointed out with particularity in the appended claims. To gain an improved understanding of the advantages and features of novelty that characterize the present invention, however, reference may be made to the descriptive matter and accompanying drawings that describe and illustrate various embodiments of the invention.

DETAILED DESCRIPTION OF THE INVENTION

The following discussion and accompanying figures disclose an article of footwear 10 in accordance with the present invention. Footwear 10 is discussed and depicted as a golf shoe. The concepts disclosed with reference to footwear 10, however, may be applied to other styles of athletic footwear, including shoes for the sports of track and field and football. In addition, the present invention may be applied to non-athletic footwear, such as sandals, boots, and dress shoes, for example. The present invention, therefore, is not limited to footwear designed solely for golf, but may also be applied to a wide range of other footwear styles.

Figure 1:
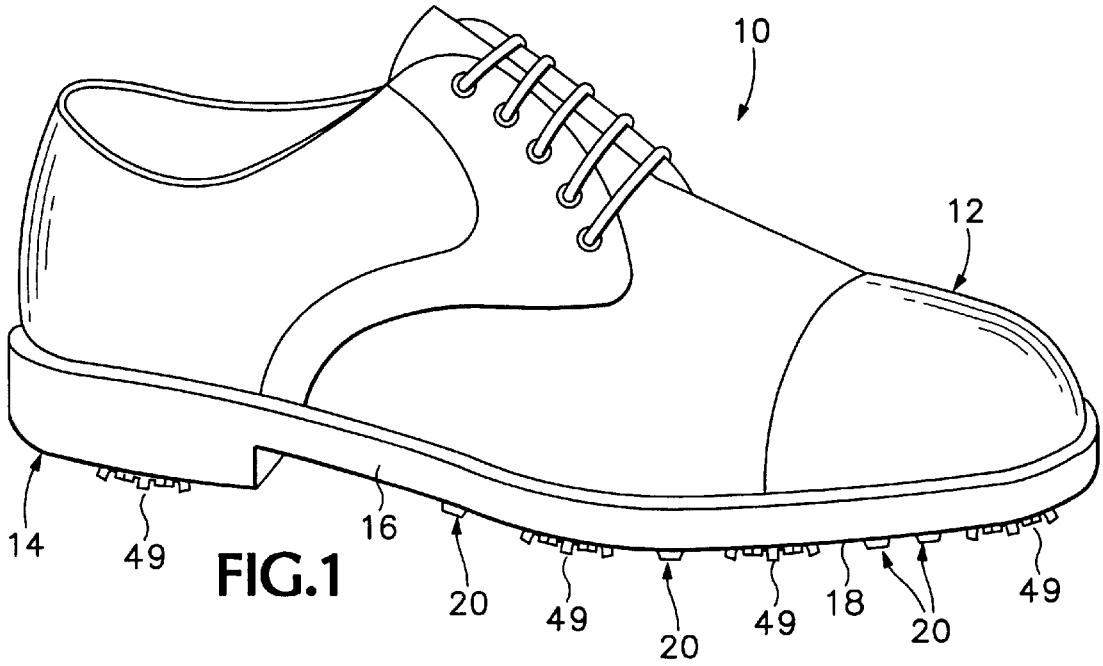
FIG. 1 is a lateral side elevational view of an article of footwear that incorporates traction elements in accordance with the present invention.

Footwear 10 is depicted in FIG. 1 and includes an upper 12 that is structured to form a foot cavity (not depicted) for receiving a foot and comfortably securing the foot to footwear 10. Upper 12 may have a generally conventional structure that is formed of a durable and comfortable leather or synthetic material, for example. Footwear 10 also includes a sole structure 14 that is attached to upper 12 and generally located between the foot cavity and the ground. Sole structure 14 is, therefore, located to provide support for the foot and may include materials such as foam that attenuate shock and absorb energy as footwear 10 makes contact with the ground. Sole structure 14 includes an outsole 16 with an exposed surface 18, and a plurality of traction elements 20 that project downward from exposed surface 18.

Figure 2A:
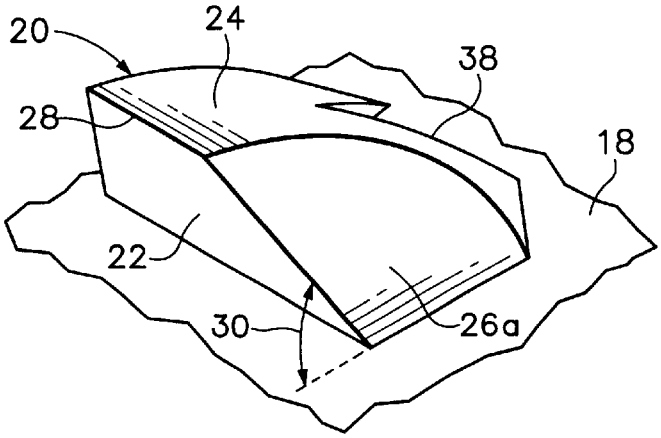
FIG. 2A is a perspective view of an individual traction element.
Figure 2B:
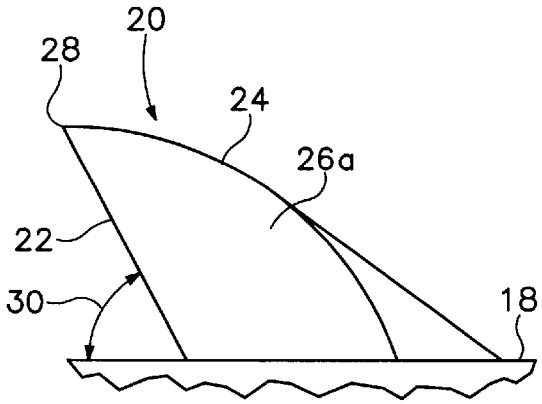
FIG. 2B is a first elevational view of the traction element.
Figure 2C:
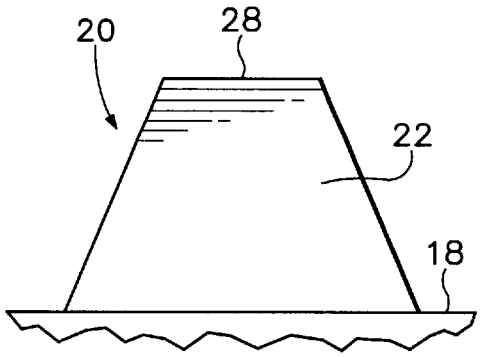
FIG. 2C is a second elevational view of the traction element.
Figure 2D:
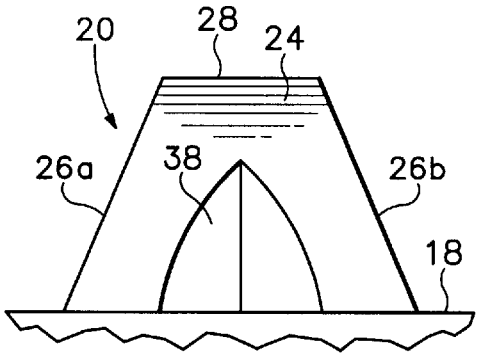
FIG. 2D is a third elevational view of the traction element.
Figure 2E:
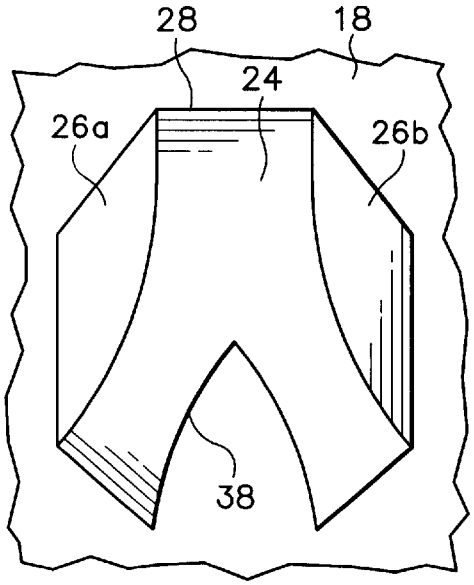
FIG. 2E is a top plan view of the traction element.

An individual traction element 20 is depicted in FIGS. 2A and 2B. Traction element 20 may be formed integral with outsole 16, or may be formed separate from outsole 16 and subsequently attached. Traction element 20 includes an undercut surface 22, a back surface 24, and a pair of side surfaces 26*a* and 26*b* that form an end portion 28 located opposite exposed surface 18. Each traction element 20 forms, therefore, a generally pointed structure that projects downward from outsole 16.

Undercut surface 22 may be planar or curved, and forms an acute angle 30 with exposed surface 18. As depicted in the figures, angle 30 is approximately 20 degrees, but may range from 10–40 degrees when traction element 20 is in a non-deformed configuration. Traction element 20 is, therefore, inclined toward undercut surface 22 such that end portion 28 is located directly below exposed surface 18.

Back surface 24 is located opposite undercut surface 22 and forms a back portion of traction element 20. Back surface 24 is depicted as being curved, but may also be planar within the scope of the present invention. A portion of back surface 24 may be bifurcated by a slit 38 to alter the deformation characteristics of each traction element 20. Side surface 26 extend between undercut surface 22 and back surface 24. Bottom portions of side surfaces 26 may flare outward adjacent to exposed surface 18 to provide a secure base for traction element 20.

Traction element 20 may be formed of a single material, including thermoplastic urethane having a Shore A hardness of approximately 75 or rubber, through a single step injection molding process. In addition, traction element 20 may be formed of a combination of materials. For example, the portion of traction element 20 adjacent to end portion 28 may be formed of a relatively durable material that resists wear, and the portion of traction element 20 adjacent to exposed surface 18 may be formed of a relatively stiff material. Although a variety of materials are suitable for traction element 20, the material selected should exhibit a deformable property, as discussed in greater detail below.

Traction elements 20 provide footwear 10 with a variety of benefits. While walking over various surfaces, traction elements 20 engage the ground to provide an individual with traction. During the game of golf, an individual may encounter terrain that includes turf, dirt, concrete, sand, and mud, for example. Traction elements 20 are configured to protrude into terrain such as turf or dirt and limit the degree that footwear 10 moves relative to the terrain. In general, end portion 28 is sufficiently pointed to penetrate a variety of surfaces such that undercut surface 22, back surface 24, and side surfaces 26 engage the ground. Friction between the ground and these surfaces will generally inhibit slipping or sliding.

Figure 3:
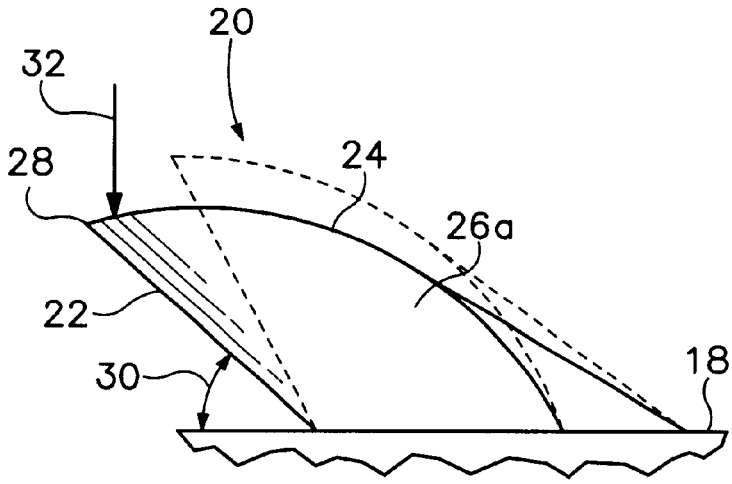
FIG. 3 is an elevational view of a traction element in a compressed configuration.

Traction elements 20 also provide the individual with cushioning by attenuating impact forces and absorbing energy as the individual walks. This provides the individual with greater comfort when traversing the long distances that comprise modem golf courses. As noted above, traction elements 20 are formed of a deformable material and, therefore, deflect in the present of compressive forces. When traction elements 20 contact and are compressed against the ground, a force directed toward outsole 16 tends to compress traction elements 20. Referring to FIG. 3, a force 32 is depicted as being incident upon the portion of back surface 24 that is adjacent to end portion 28. In general, the ground will contact traction elements 20 in this area and traction elements 20 will deflect toward exposed surface 18, thereby decreasing angle 30. FIG. 3 depicts traction element 20 in the compressed configuration, with the non-compressed, non-deformed configuration shown in dashed lines.

The compression of traction elements 20 is most pronounced on less penetrable surfaces, such as concrete or hard dirt. Accordingly, the cushioning properties of traction elements 20 have their greatest effect on relatively non-compliant surfaces. On more penetrable surfaces, however, traction elements 20 protrude into the ground, thereby significantly decreasing the compression of traction elements 20. Although traction elements 20 do not provide a significant amount of additional cushioning on more penetrable surfaces, such surfaces are generally compliant and little additional cushioning is required.

An additional benefit of traction elements 20 relates to the manner in which the rotation of the foot during the various stages of the golf swing is controlled. As discussed in the Description of Background Art section, the feet have a tendency to rotate during portions of the golf swing. More specifically, the driving foot, which is positioned furthest from the flag, tends to rotate laterally outward in the forefoot area and medially inward in the heel area during the back swing. Similarly, the stabilizing foot, which is positioned closest to the flag, tends to rotate laterally outward in the forefoot area and medially inward in the heel area during the down swing. Traction elements 20 are structured to resist rotation of footwear 10 in the direction that each undercut surface 22 faces. That is, traction elements 20 may be oriented with undercut surfaces 22 facing in the direction of unwanted rotation to effectively limit the degree of rotation. Combined with a proper orientation, as discussed in greater detail below, a plurality of traction elements 20 may be utilized to effectively limit the degree of rotation in the driving foot and the stabilizing foot during the back swing and down swing.

Figure 4A:
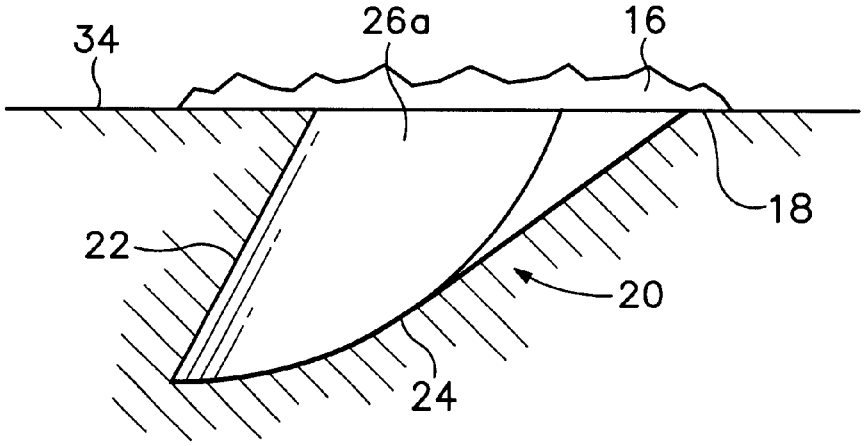
FIG. 4A is a side elevational view of a traction element protruding into the ground.
Figure 4B:
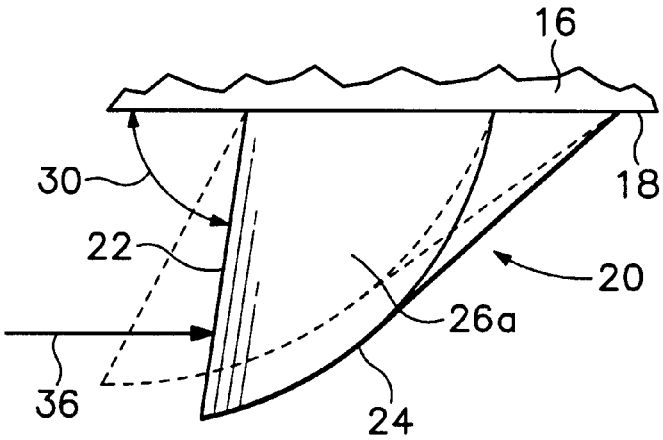
FIG. 4B is a side elevational view of a traction element in a deformed configuration.

Referring to FIG. 4A, an individual traction element 20 is depicted as protruding into the ground, which is represented by reference numeral 34, such that exposed surface 18 is located adjacent the ground. When an individual is preparing to swing a golf club, each traction element 20 may be engaged with the ground as depicted in FIG. 4A. In general, forces incident traction element 20 during preparation for the swing will be minimal and, therefore, traction element 20 will be in an undeformed configuration. During the swing, however, each foot tends to rotate. Assuming, for example, that the traction element 20 depicted in FIG. 4A is located in a forefoot area of footwear 10 and is oriented toward a lateral side of footwear 10, then the ground will induce a substantially horizontal force on undercut surface 22 during the back swing, as represented by force 36 in FIG. 4B. Force 36 will deform traction element 20, thereby increasing angle 30. The forces typically generated by an individual during portions of the golf swing, however, will generally not be sufficient to increase angle 30 to 90 degrees or more. Accordingly, angle 30 will remain acute throughout the golf swing.

Prior to the golf swing, and throughout the golf swing, undercut surface 22 faces the direction of rotation. The undercut formed by undercut surface 22 engages the ground in a manner that is similar to the teeth on a saw. Accordingly, the undercut tends to remain engaged with the ground, particularly when a force is developed between undercut surface 22 and the ground. Like the teeth of a saw, therefore, traction element 20 tends to become more securely Pa engaged when a force is incident upon undercut surface 22 The force, however, will generally not be sufficient to deform traction element 20 to the degree that angle 30 becomes non-acute. The deformation in traction element 20 will not, therefore, affect the propensity of traction element 20 to remain engaged with the ground.

Following the golf swing, the rotational forces in the feet will subside and traction element 20 will return to the undeformed configuration. Traction elements 20 are not configured to remain engaged with the ground following the golf swing and will slide out of the ground with the application of an upward force by the feet. The curved shape to back surface 24 also promotes disengagement between traction elements 20 and the ground. Whereas, the undercut formed by undercut surface 22 tends to securely engage traction elements 20 and the ground, the curved geometry of back surface 24 has the opposite effect. Accordingly, the configuration of back surface 24 promotes release between traction element 20 and the ground following the golf swing.

Figure 5:
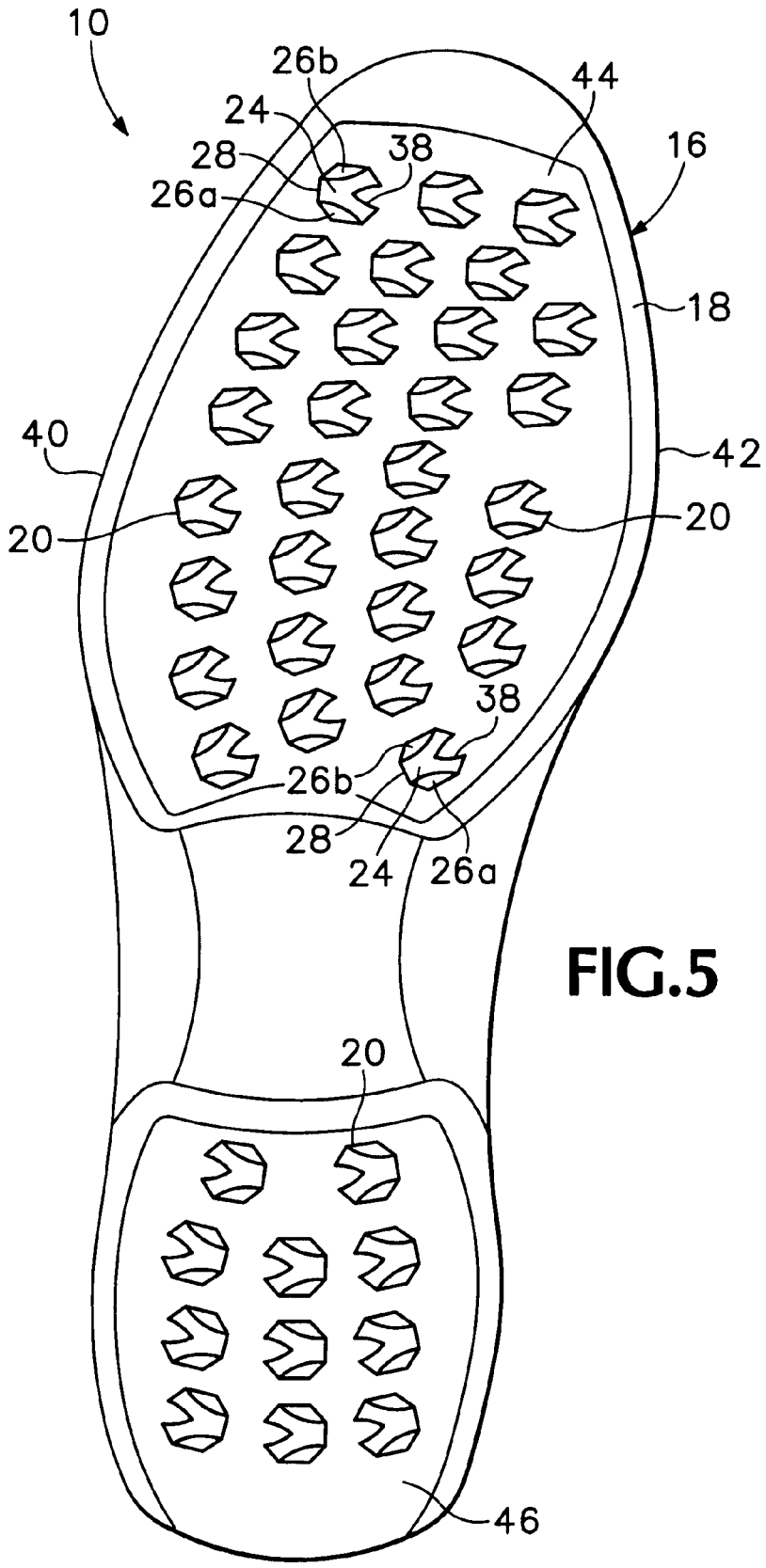
FIG. 5 is a first bottom plan view of the article of footwear depicted in FIG. 1.

In order for traction elements 20 to effectively limit the rotational forces in the feet during the back swing and down swing, a plurality of traction elements 20 should be properly oriented on exposed surface 18 of a pair of footwear 10. FIG. 5 depicts a bottom plan view of footwear 10. To aid in the following discussion concerning the orientation of traction elements 20, footwear 10 includes a lateral side 40, a opposite medial side 42, a forefoot area 44 generally located in a forefoot portion of footwear 10, and a heel area 46 generally located in a heel area of footwear 10.

During the back swing, the driving foot tends to rotate laterally outward in forefoot area 44 and medially inward in heel area 46. With reference to forefoot area 44, undercut surfaces 22 generally face toward lateral side 40. Accordingly, traction elements 20 in forefoot area 44 will inhibit the movement of footwear 10 toward lateral side 40. Similarly, undercut surfaces 22 located in heel area 46 generally face toward medial side 36. Accordingly, traction elements 20 in heel area 46 will inhibit the movement of footwear 10 toward medial side 42. The configuration of traction elements 20 depicted in FIG. 5 will, therefore, effectively limit rotation of the foot during the back swing. During the down swing, the stabilizing foot tends to rotate laterally outward in forefoot area 44 and medially inward in heel area 46. An article of footwear that is a mirror image of footwear 10, as depicted in FIG. 5, may be utilized, therefore, to limit rotation in the stabilizing foot during the down swing. Unlike many prior art articles of footwear that have a different configuration depending upon whether the right foot or the left foot is the driving foot, footwear 10 may be utilized by an individual regardless of the foot that is selected as the driving foot.

Figure 6:
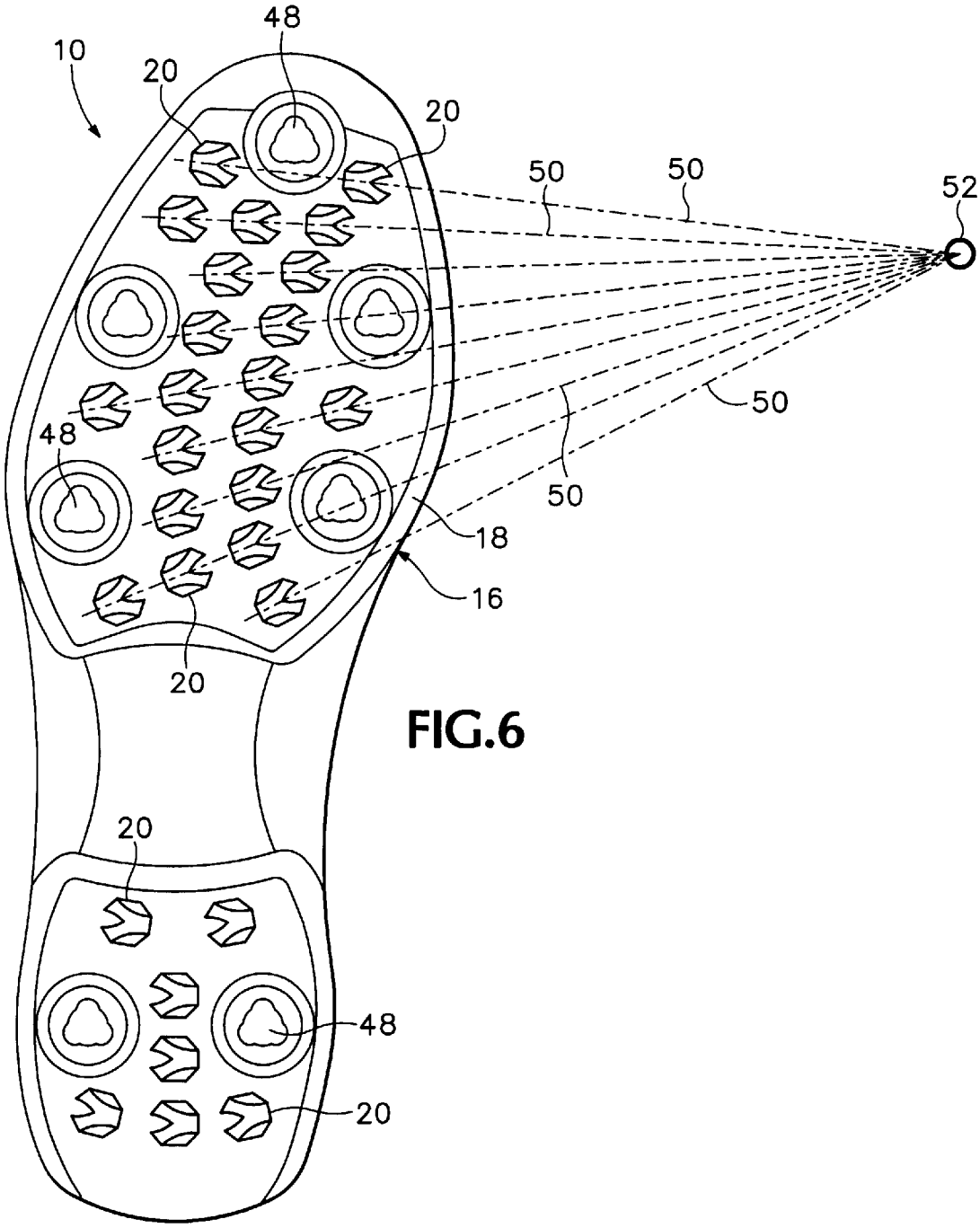
FIG. 6 is a second bottom plan view of the footwear depicted in FIG. 1 showing traction element orientation.

As discussed above, traction elements 20 located in forefoot area 44 generally have undercut surfaces 22 that face lateral side 40, and traction elements 20 located in heel area 46 generally have undercut surfaces that face medial side 42. Although traction elements 20 may be randomly distributed on exposed surface 18, the portion of traction elements 20 located in forefoot area 44, as depicted in FIG. 6, are aligned along a plurality of radial lines 50 that emanate from a localized region 52. This configuration orients undercut surfaces 22 in different directions that all generally face lateral side 40. Every individual has a golf swing with different characteristics and will, therefore, have a different point of rotation in the feet. Differences in the precise direction in which undercut surfaces 22 face will generally ensure that at least a portion of the traction elements 20 located within forefoot area 44 have undercut surfaces 22 that are oriented directly into the direction of rotation.

Figure 7A:
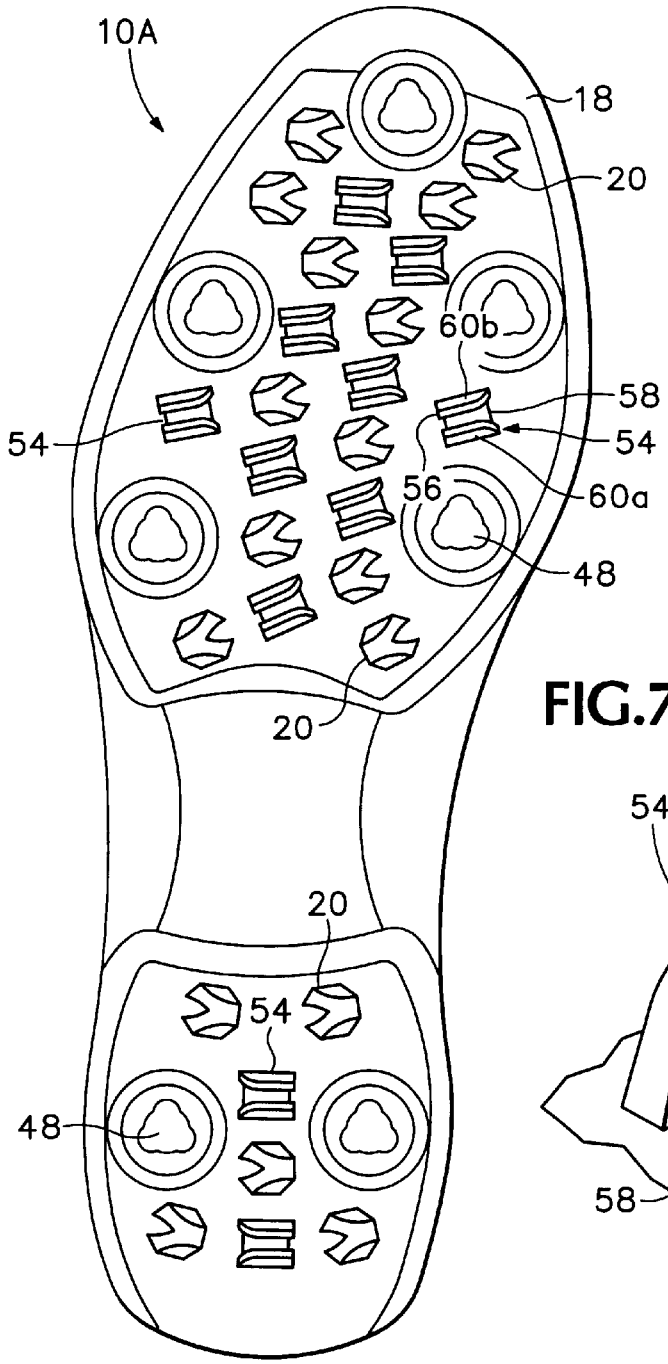
FIG. 7A is bottom plan view of an article of footwear that includes traction elements and secondary traction elements.

The above discussion discloses footwear 10 and the many considerations relevant to the structure and function of traction elements 20. Footwear 10 may also include other elements, such as spike receptacles 48, as depicted in FIG. 6, that receive either metal spikes or supplemental polymer spikes 49, as depicted in FIG. 1. Although traction elements 20 are effective in preventing rotation of the feet, particularly on the short grass surfaces that characterize the area for initially hitting a golf ball, spikes 49 may be utilized to prevent the foot from slipping on other surfaces, such as longer grass or rocky terrain, for example. In addition, traction elements may weaken due to continued compressions against surfaces such as concrete. FIG. 7A depicts an article of footwear 10A with a configuration wherein a plurality of secondary traction elements 54 are distributed among traction elements 20. Secondary traction elements 54 contact surfaces such as concrete and effectively form a gap between exposed surface 18 and the surface, thereby limiting the degree to which traction elements 20 compress.

Figure 7B:
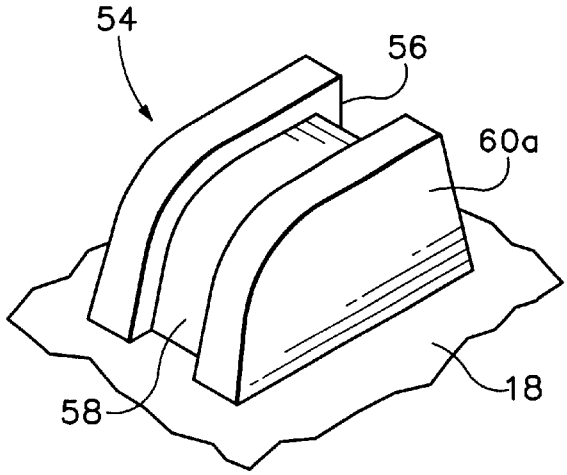
FIG. 7B is a perspective view of an individual secondary traction element of the footwear depicted in FIG. 7A.

Secondary traction elements 54 may have a configuration that promotes the rotation-resisting properties of traction elements 20, and, therefore, function as secondary traction elements. As depicted in FIGS. 7A and 7B, secondary traction elements 54 each have a gripping surface 56, an opposite back surface 58, and a pair of side surfaces 60a and 60b. In general, gripping surfaces 56 are perpendicular to exposed surface 18 and are oriented to face the same direction as undercut surfaces 22. When compressed into a compliant surface, such as turf, gripping surfaces 56 will also engage the ground to resist rotation of footwear 10A. Accordingly, secondary traction elements 54 may be utilized in combination with traction elements 20 to limit the degree of compression in traction elements 20 and assist in inhibiting rotation of footwear 10A. In an alternate embodiment of the present invention, gripping surfaces 56 of secondary traction elements 54 may also have an undercut that is similar to undercut surfaces 22.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the relevant art will recognize that numerous variations and modifications may be made to the embodiments without departing from the scope of the present invention, as defined by the appended claims.

That which is claimed is:

1. An article of footwear for resisting a rotational motion, said footwear including an upper for receiving a foot and a sole structure attached to said upper, said sole structure comprising:

an outsole with an exposed surface; and a plurality of traction elements projecting from said exposed surface, each said traction element having an end portion located opposite said exposed surface, and each said traction element having an undercut surface that extends between said exposed surface and said end portion, said undercut surface forming an acute angle with said exposed surface, wherein a forefoot portion of said plurality of said traction elements are located in a forefoot area of said sole structure, and a heel portion of said plurality of said traction elements are located in a heel area of said sole structure, substantially all of said undercut surfaces of said forefoot portion being oriented to generally face a lateral side of said footwear, and said undercut surfaces of said heel portion being oriented to generally face a medial side of said footwear.

2. The article of footwear of claim 1, wherein said traction elements are formed of a deformable material.

3. The article of footwear of claim 1, wherein said undercut surface is substantially planar.

4. The article of footwear of claim 3, wherein at least one said traction element includes a curved surface located opposite said undercut surface, said curved surface extending between said exposed surface and said end portion.

5. The article of footwear of claim 4, wherein said curved surface is bifurcated adjacent to said exposed surface.

6. The article of footwear of claim 4, wherein said at least one said traction element includes a pair of side surfaces.

7. The article of footwear of claim 1, wherein at least one said traction element is formed of a first material and a second material, said first material being located adjacent to said exposed surface, and said second material forming said end portion.

8. The article of footwear of claim 1, wherein said forefoot portion are aligned along a plurality of radial lines that emanate from a localized region spaced outward from a medial side of side of said footwear.

9. The article of footwear of claim 8, wherein said undercut surfaces of said forefoot portion are oriented to face away from said localized region.

10. The article of footwear of claim 1, wherein said traction elements are formed of a deformable material and forces directed toward said undercut surfaces compress said traction elements and increase said acute angle.

11. An article of footwear including an upper for receiving a foot and a sole structure attached to said upper, said sole structure comprising:

an outsole with an exposed surface; and a plurality of traction elements projecting from said exposed surface, said traction elements having an end portion located opposite said exposed surface and an undercut surface that extends between said exposed surface and said end portion, said undercut surface forming an acute angle with said exposed surface, at least a forefoot portion of said plurality of said traction elements being located in a forefoot area of said footwear, substantially all of said undercut surfaces of said forefoot portion being oriented to generally face a lateral side of said footwear, wherein said traction elements are formed of a deformable material and deform in response to a force that is incident said undercut surface, thereby increasing said acute angle formed between said undercut surface and said exposed surface, and each said traction element returns to an undeformed configuration following a removal of said force.

12. The article of footwear of claim 11, wherein said undercut surface is substantially planar.

13. The article of footwear of claim 12, wherein at least one said traction element includes a curved surface located opposite said undercut surface, said curved surface extending between said exposed surface and said end portion to thereby intersect said undercut surface.

14. The article of footwear of claim 11, wherein said deformable material is a first material and a second material, said first material being located adjacent to said exposed surface and said second material forming said end portion.

15. The article of footwear of claim 11, wherein said forefoot portion are aligned along a plurality of radial lines that emanate from a localized region spaced outward from a medial side of side of said footwear.

16. The article of footwear of claim 15, wherein said undercut surfaces of said forefoot portion are oriented to face away from said localized region.

17. The article of footwear of claim 11, wherein a heel portion of said plurality of said traction elements are located in a heel area of said sole structure, and said undercut surfaces of said heel portion being oriented to generally face a medial side of said footwear.

18. The article of footwear claim 11, wherein forces directed toward said undercut surfaces compress said traction elements and increase said acute angle.

19. An article of footwear having a sole structure, said sole structure including an outsole and a plurality of traction elements projecting from an exposed surface of said outsole, said traction elements comprising:

an end portion located opposite said exposed surface;

an undercut surface that extends between said exposed surface and said end portion, said undercut surface forming an acute angle with said exposed surface; and a back surface located opposite said undercut surface, said back surface extending between said exposed surface and said end portion to thereby intersect said undercut surface, a forefoot portion of said plurality of said traction elements being located in a forefoot area of said sole structure, said undercut surfaces of said forefoot portion being oriented to generally face towards a lateral side of said sole structure, and said undercut surfaces of said forefoot portion being oriented to generally face away from a localized region spaced outward from a medial side of said sole structure, and a heel portion of said plurality of said traction elements being located in a heel area of said sole structure, substantially all of said undercut surfaces of said heel portion being oriented to generally face a medial side of said sole structure.

20. The article of footwear of claim 19, wherein said undercut surface is substantially planar.

21. The article of footwear of claim 19, wherein said back surface is curved.

22. The article of footwear of claim 21, wherein said back surface is bifurcated adjacent to said exposed surface.

23. The article of footwear of claim 19, wherein each said traction element is formed of a first material and a second material, said first material being located adjacent to said exposed surface and said second material forming said end portion.

24. The article of footwear of claim 19, wherein said forefoot portion are aligned along a plurality of radial lines that emanate from said localized region.

25. The article of footwear of claim 19, wherein said traction elements are compressible.

26. An article of footwear having a sole structure, said sole structure including an outsole and a plurality of traction elements formed of a deformable material, said traction elements projecting from an exposed surface of said outsole, and said traction elements comprising:

an end portion located opposite said exposed surface;

a substantially planar undercut surface that extends between said exposed surface and said end portion, said undercut surface forming an acute angle with said exposed surface; and a curved surface located opposite said undercut surface, said cured surface extending between said exposed surface and said end portion to thereby intersect said undercut surface, a forefoot portion of said plurality of said traction elements being located in a forefoot area of said sole structure and spaced inward from a perimeter of said sole structure, said forefoot portion being aligned along a plurality of radial lines that emanate from a localized region spaced outward from a medial side of said sole structure, said undercut surfaces of said forefoot portion being oriented to generally face away from said localized region and towards a lateral side of said footwear, and a heel portion of said plurality of said traction elements being located in a heel area of said sole structure, said undercut surfaces of said heel portion being oriented to generally face a medial side of said sole structure.

27. The article of footwear of claim 26, wherein said deformable material is a first material and a second material, said first material being located adjacent to said exposed surface and said second material forming said end portion.

28. The article of footwear of claim 26, wherein said traction elements compressible.

29. An article of footwear for resisting a rotational motion, said footwear including an upper for receiving a foot and a sole structure attached to said upper, said sole structure comprising:

an outsole with an exposed surface; and a plurality of traction elements projecting from said exposed surface, each said traction element having an end portion located opposite said exposed surface, and each said traction element having an undercut surface that extends between said exposed surface and said end portion, said undercut surface forming an acute angle with said exposed surface, wherein a forefoot portion of said plurality of said traction elements are located in a forefoot area of said sole structure and are spaced inward from a perimeter of said sole structure and a heel portion of said plurality of said traction elements are located in a heel area of said sole structure, said undercut surfaces of said forefoot portion being oriented to generally face a lateral side of said footwear, and said undercut surfaces of said heel portion being oriented to generally face a medial side of said footwear.

30. The article of footwear of claim 29, wherein said traction elements are formed of a deformable material.

31. The article of footwear of claim 29, wherein said undercut surface is substantially planar.

32. The article of footwear of claim 31, wherein at least one said traction element includes a curved surface located opposite said undercut surface, said curved surface extending between said exposed surface and said end portion.

33. The article of footwear of claim 32, wherein said curved surface is bifurcated adjacent to said exposed surface.

34. The article of footwear of claim 29, wherein at least one said traction element is formed of a first material and a second material said first material being located adjacent to said exposed surface, and said second material forming said end portion.

35. The article of footwear of claim 29, where said traction elements are formed of a deformable material and forces directed toward said undercut surfaces compress said traction elements and increase said acute angle.

36. An article of footwear for resisting a rotational motion, said footwear including an upper for receiving a foot and a sole structure attached to said upper, said sole structure comprising:

an outsole with an exposed surface; and a plurality of traction elements projecting from said exposed surface, each said traction element having an end portion located opposite said exposed surface, and each said traction element having an undercut surface that extends between said exposed surface and said end portion, said undercut surface forming an acute angle with said exposed surface, and said undercut surface being substantially planar, at least one said traction elements including a curved surface located opposite said undercut surface, said curved surface extending between said exposed surface and said end portion, and said cured surface being bifurcated adjacent to said exposed surface, wherein a forefoot portion of said plurality of said traction elements are located in a forefoot area of said sole structure, and a heel portion of said plurality of said traction elements arc located in a heel area of said sole structure, said undercut surfaces of said forefoot portion being oriented to generally face a lateral side of said footwear, and said undercut surfaces of said heel portion being oriented to generally face a medial side of said footwear.

37. An article of footwear including an upper for receiving a foot and a sole structure attached to said upper, said sole structure comprising:

an outsole with an exposed surface; and a plurality of traction elements projecting from said exposed surface and spaced inward from a perimeter of said sole structure, said traction elements having an end portion located opposite said exposed surface and an undercut surface that extends between said exposed surface and said end portion, said undercut surface forming an acute angle with said exposed surface, at least a forefoot portion of said plurality of said traction elements being located in a forefoot area of said footwear, said undercut surfaces of said forefoot portion being oriented to generally face a lateral side of said footwear, wherein said traction elements are formed of a deformable material and deform in response to a force that is incident said undercut surface, thereby increasing said acute angle formed between said undercut surface and said exposed surface, and each said traction element returns to an undeformed configuration following a removal of said force.

38. The article of footwear of claim 37, wherein said undercut surface is substantially planar.

39. The article of footwear of claim 38, wherein at least one said traction element includes a curved surface located opposite said undercut surface, said curved surface extending between said exposed surface and said end portion to thereby intersect said undercut surface.

40. The article of footwear of claim 37, wherein said deformable material is a first material and a second material, said first material being located adjacent to said exposed surface and said second material forming said end portion.

41. The article of footwear of claim 37, wherein a heel portion of said plurality of said traction elements are located in a heel area of said sole structure, and said undercut surfaces of said heel portion being oriented to generally face a medial side of said footwear.

42. An article of footwear having a sole structure, said sole structure including an outsole and a plurality of traction elements projecting from an exposed surface of said outsole, said traction elements comprising:

an end portion located opposite said exposed surface;

an undercut surface that extends between said exposed surface and said end portion, said undercut surface forming an acute angle with said exposed surface; and a back surface located opposite said undercut surface, said back surface extending between said exposed surface and said end portion to thereby intersect said undercut surface, a forefoot portion of said plurality of said traction elements being located in a forefoot area of said sole structure and spaced inward from a perimeter of said sole structure, said undercut surfaces of said forefoot portion being oriented to generally face towards a lateral side of said sole structure, and said undercut surfaces of said forefoot portion being oriented to generally face away from a localized region spaced outward from a medial side of said sole structure, and a heel portion of said plurality of said traction elements being located in a heel area of said sole structure, said undercut surfaces of said heel portion being oriented to generally face a medial side of said sole structure.

43. The article of footwear of claim 42, wherein said undercut surface is substantially planar.

44. The article of footwear of claim 42, wherein said back surface is curved.

45. The article of footwear of claim 44, wherein said back surface is bifurcated adjacent to said exposed surface.

46. The article of footwear of claim 42, wherein each said traction element is formed of a first material and a second material, said first material being located adjacent to said exposed surface and said second material forming said end portion.

47. An article of footwear having a sole structure, said sole structure including an outsole and a plurality of traction elements formed of a deformable material, said traction elements projecting from an exposed surface of said outsole, and said traction elements comprising:

an end portion located opposite said exposed surface;

a substantially planar undercut surface that extends between said exposed surface and said end portion, said undercut surface forming an acute angle with said exposed surface; and a curved surface located opposite said undercut surface, said curved surface extending between said exposed surface and said end portion to thereby intersect said undercut surface, said curved surface being bifurcated adjacent to said exposed surface, a forefoot portion of said plurality of said traction elements being located in a forefoot area of said sole structure, said forefoot portion being aligned along a plurality of radial lines that emanate from a localized region spaced outward form a medial side of said sole structure, said undercut surfaces of said forefoot portion being oriented to generally face away from said localized region and towards a lateral side of said footwear, and a heel portion of said plurality of said traction elements being located in a heel area of said sole structure, said undercut surfaces of said heel portion being oriented to generally face a medial side of said sole structure.

* * * * *